United States Patent [19]

Sanborn

[11] Patent Number: 4,912,613

[45] Date of Patent: Mar. 27, 1990

[54] COVER LENS FOR LIGHT

[75] Inventor: Bruce A. Sanborn, Rochester, N.Y.

[73] Assignee: MDT Corporation, Rochester, N.Y.

[21] Appl. No.: 315,550

[22] Filed: Feb. 27, 1989

[51] Int. Cl.[4] ..... F21V 5/04

[52] U.S. Cl. ..... 362/336; 362/309; 350/167

[58] Field of Search ..... 362/309, 330, 332, 333, 362/336, 338, 804; 350/167; 65/112; 51/283 R, 284 R, 109 R, 125, 281 R

[56] References Cited

U.S. PATENT DOCUMENTS

| | | | |
|---|---|---|---|
| 1,243,652 | 10/1917 | Casey | 362/336 |
| 1,249,408 | 12/1917 | Johanson | 362/336 |
| 2,482,287 | 9/1949 | Packer et al. | 362/309 |
| 3,005,087 | 10/1961 | Klein | 240/1.4 |
| 3,588,488 | 6/1971 | Lauterbach | 240/1.4 |
| 3,763,369 | 10/1973 | Lewin | 362/330 |
| 3,887,801 | 6/1975 | Ilzig et al. | 240/1.4 |
| 4,196,460 | 4/1980 | Schreckendgust | 362/231 |
| 4,380,794 | 4/1983 | Lawson | 362/296 |
| 4,703,405 | 10/1987 | Lewin | 362/330 |

*Primary Examiner*—Ira S. Lazarus
*Assistant Examiner*—Richard R. Cole
*Attorney, Agent, or Firm*—Trask, Britt & Rossa

[57] ABSTRACT

A cover lens element for a surgical light includes a clear plastic light path region which may be smooth and flat on one surface but which is dimpled on its other surface with numerous overlapping spherical depressions which in combination present an array of plano-concave negative lenses.

30 Claims, 2 Drawing Sheets

COVER LENS FOR LIGHT

BACKGROUND OF THE INVENTION

1. Field

This invention pertains to lights of the type in which a light source is focused through a lens to produce a concentrated spot of light on the work area. It is particularly directed to an improved diffusion lens element for such lights and provides such a lens element which is especially useful in connection with surgical lights.

2. State of the Art

Lights have long been available in which a light source is focused through a light path region of a lens element to produce a concentrated spot of light on a work area. Exemplary of such lights are those which are used by surgeons to illuminate an operative sight. Typical such surgical lights are disclosed, for example, by U.S. Pat. Nos. 3,005,087; 3,588,488; 3,887,801; 4,196,460; and 4,380,794 the disclosures of which are incorporated by reference as a part of this disclosure for their teachings concerning the general structure and operation of such lights as well as the general construction and arrangement of light cover lenses and the optical design of such lenses.

An important design criterion and objective in the design of surgical lights and the cover lenses incorporated in such lights is the ability to produce a concentrated spot of light which is of uniform intensity gradation "center-to-edge." Light patterns resulting from irregularities in the reflector and/or lamp assemblies housed by the light opposite the lens from the work site are distracting. Various expedients have been suggested for smoothing the light pattern produced by surgical lights. It has become conventional practice to lightly frost one or both surfaces of the cover lens for example. Various honeycombed or other light-diffusing surface textures have also been attempted. Such lens surface treatments constitute means both for smoothing the light pattern and for disrupting a direct view of the internal components of the surgical light, a view which is also distracting and aesthetically displeasing.

The techniques adopted in the lighting art for smoothing the light pattern and for obstructing a direct view of the internal components of the light have generally been accompanied by a reduction in efficiency (reduced light transmission and/or increased light scatter). Moreover, the surface characteristics of currently available cover lenses are not closely defined, being largely subjective. Thus, it is difficult to manufacture such cover lenses with consistent optical properties.

SUMMARY OF THE INVENTION

The present invention provides an improved lens element useful as a cover lens for any light of the type in which a light source is focused through a light path region of a lens element to produce a concentrated spot of light on a work area. Because the improved lens of this invention is currently of most interest to surgical lights, this disclosure will make primary reference to such lights throughout. Nevertheless, the structure disclosed in connection with surgical lights is directly applicable to other lights of the same class. The lens element of this invention may be structured in various ways and take various configurations, but will, in all events, include a light path region within the perimeter of the element interposed between the work area; (i.e. a surgical site), and the internal components of the light;

(e.g., a lamp assembly, which typically includes one or more electrical lamps, sockets, reflectors, and focusing apparatus).

The lens element may be comprised almost entirely of the light path region, but may include, particularly about its perimeter, structures which facilitate the attachment of the element to a light housing. The lens element and/or the light path region of the lens element, may take a variety of shapes but is most typically configurated as a disk having first and second surfaces approximately parallel each other. Apart from the optical design described in detail in this disclosure, the lens element may be fashioned in conventional manner such as by molding or by machining from disks of clear glass or plastic, (typically polycarbonate or acrylic), material.

According to this invention a plurality of plano-concave negative lenses are arranged in an array throughout the light path region of the lens element. The array is formed from spherical depressions in at least one surface of the lens element, each depression being in open communication with th surface. The depressions are arranged so that individual such depressions overlap adjacent depressions, thereby to provide a dimpled texture with the optical properties of a multiplicity of intersecting spherical lenses.

As compared to a conventional frosted lens of the type currently in use, a lens element of this invention provides a more uniform intensity gradation from the center of the concentrated spot of light to the edges of the spot. The claimed lens smoothes the light pattern for uniform intensity and also reduces the effects on the light pattern from irregularites caused by the internal components of the light, particularly in the reflector and lamp assembly. The lens further helps to maintain a consistent light pattern size during focusing. Moreover, the multi-element nature of the dimpled lens disrupts a direct view of the internal components of the light, thereby producing an aesthetically more pleasing appearance. The improvement of this invention also offers higher light transmission and reduced light scatter, as compared to the frosted flat lenses of the prior art. A notable advantage of the present invention is that the lens surface characteristics are more closely defined than the largely subjective frosted surfaces previously relied upon. The claimed lenses may thus be manufactured with greater consistency.

In most instances, the second surface of the lens element in the vicinity of the light path region will be smooth and flat. This smooth flat surface will ordinarily, but not necessarily, be oriented towards the work area with the dimpled surface being oriented towards the light source.

While the lens element may be formed from any mechanically suitable clear material capable of passing visible light, it is presently preferred to form the light path region of the lens element from a clear plastic lens material. Any of the materials currently in use for lenses and their equivalents are generally acceptable. Polycarbonate and acrylic plastic materials with good optical and mechanical properties are presently considered to be ideal. It is highly preferred that both surfaces of the lens be smooth and polished.

The lens of this invention may be fabricated in various ways, including molding, casting or machining, but in any event, will present an array of overlapping concave spherical depressions similar to a reference array formed by machining the plurality of depressions with an end mill having a radius of curvature which is very large in comparison to the effective circumference of the depressions. By "effective circumference" is meant the circumference of the circle formed in a flat surface by milling a single depression into that surface. For example, an end mill having a radius of approximately 18 inches, milling a less than 1/50 inch deep cut into a plastic sheet will produce a spherical depression with an effective diameter of approximately one inch, and an effective circumference of approximately three inches, measured at the surface of the lens. Generally, the radius of the end mill is sufficiently large to exceed the width of the light path region of the lens, and the depth of cut of each depression will be sufficiently less than the distance between first and second surfaces of the lens (the thickness of the lens element) to assure structural integrity of the lens element in use. The spacing of the depressions should be such that each depression overlaps no fewer than three adjacent depressions. Thus, the effective circumferences and diameters of the various depressions overlap adjacent circumferences and diameters so that the resulting depressions, while retaining spherical optical properties, do not retain a circular appearance at the intersections with the lens surface.

The array of cuts (spherical depressions) may be positioned randomly throughout the entire light path region, but more typically forms a pattern generated by overlapping cuts made on centers located on concentric circles. A presently preferred family of such patterns places concentric circles, having respective radii originating at approximately the center of the light path region, approximately equally radially spaced. The centers of the overlapping cuts are located on each of the concentric circles at approximately evenly spaced positions.

Presently preferred patterns of the array are achieved when the distance between centers of adjacent cuts on the concentric circles is similar to the radial distance separating adjacent circles. Further, desirable patterns are achieved when the depths of individual cuts are sufficient to achieve an effective diameter greater than the radial distance between adjacent circles. Ideally, the depth of cut should be less than about half the thickness of the lens element.

The spherical lenses resulting from the patterns and constituting the array need not and ordinarily will not be identical in appearance. A random appearance is considered desirable. Accordingly, the preferred embodiments locate the centers of the individual depressions to avoid defining radial lines originating at the center of the light path region and extending to the perimeter of that region.

BRIEF DESCRIPTION OF THE DRAWINGS

In the drawings which illustrate what is currently regarded as the best mode for carrying out the invention.

DESCRIPTION OF THE ILLUSTRATED EMBODIMENT

Figure 1:
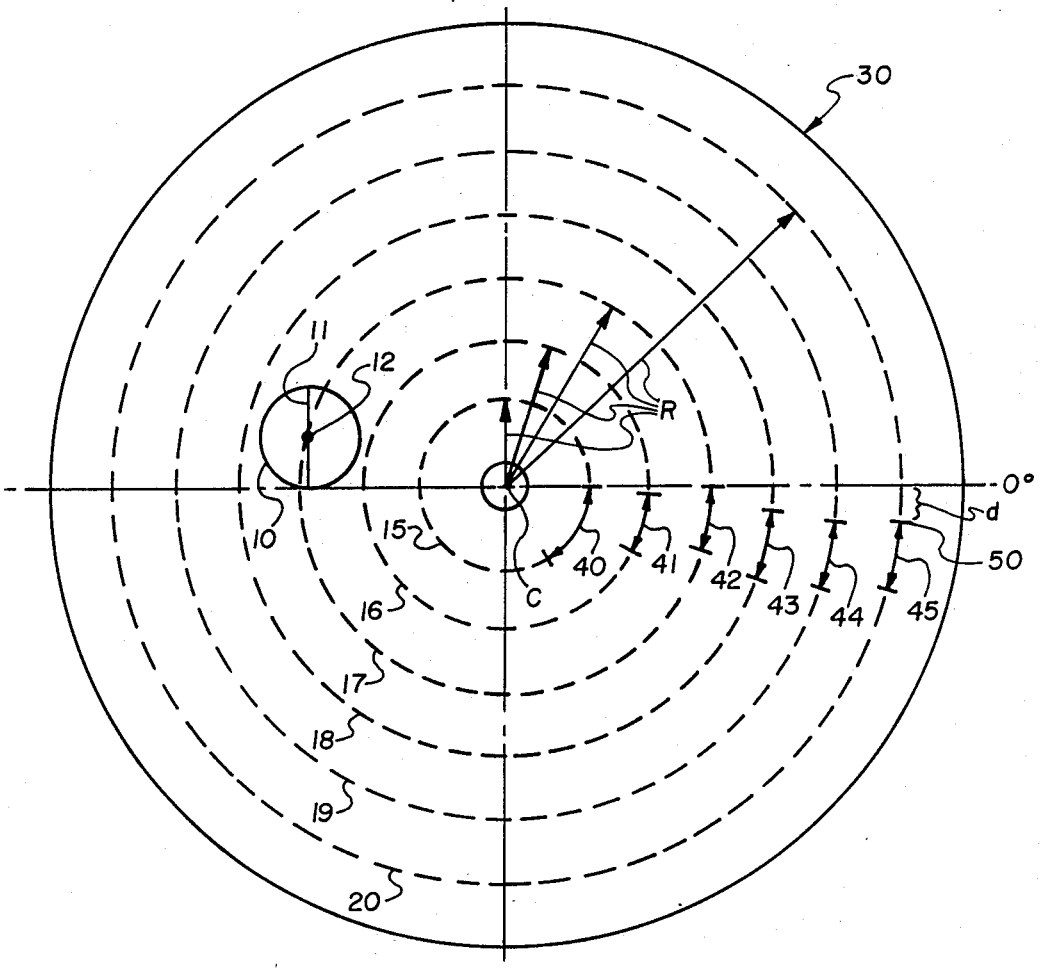
FIG. 1 is a schematic illustration of the layout of one embodiment of the invention.

FIG. 1 illustrates a layout for machining a multiplicity of plano-concave lenses by overlapping cuts with an 18 inch radius spherical end cutter to a depth of 0.011 inches, thereby producing depressions 10 having an effective diameter 11 of approximately 1.25 inches. The center 12 of the depressions 10 are located on concentric circles 15, 16, 17, 18, 19, 20 with radii R extending from the center C of the lens light path region 30. Angles 40, 41, 42, 43, 44 and 45 illustrate the orientation and degrees of separation of adjacent center points on the respective concentric circles. The first center location, e.g. 50 on each of the circles, e.g. 20 may be offset from a 0° reference by an angle d. The locations of the individual centers of each cut for the example illustrated are reported in Table I.

TABLE I

Location of Centers for a Light Path Region of the Lens Element Illustrated By FIG. 1

| Circle Number | Radius (Inches) | Number of Cuts | Separation of Centers (Degrees) | Separation of Centers (Inches) | Offset from 0° (Degrees Clockwise) |
|---|---|---|---|---|---|
| 15 | 1.0 | 6 | 60 | 1.05 | 0 |
| 16 | 1.75 | 15 | 24 | .73 | 3 |
| 17 | 2.5 | 20 | 18 | .79 | 0 |
| 18 | 3.25 | 24 | 15 | .85 | 5 |
| 19 | 4.0 | 30 | 12 | .84 | 6 |
| 20 | 4.75 | 36 | 10 | .83 | 5 |

Figure 2:
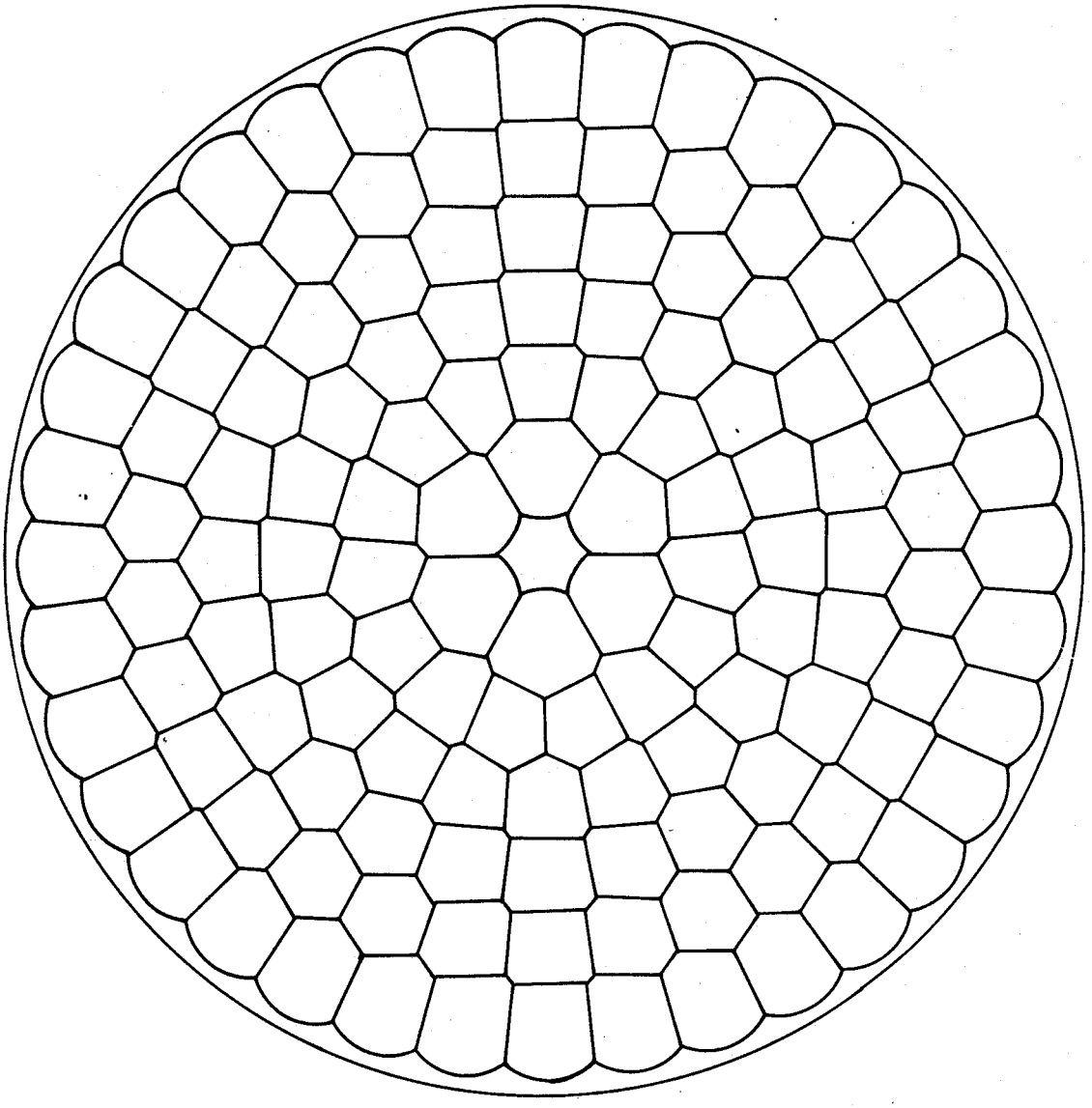
FIG. 2 is a plan view of an alternative embodiment of the invention constructed in accordance with a layout similar but not identical, to that of FIG. 1.

FIG. 2 illustrates the appearance of an array constructed in accordance with the pattern illustrated by FIG. 1 and specified by Table I except without any offsets d. It should be recognized that while Table I reports radii to two place decimal accuracy and inches of separation with similar precision, a substantial deviation from such precision is tolerable. For example, the radius for circle No. 16 is designated 1.75 but should be understood to mean approximately 1¾ inches. Similarly, while the inches of separation are reported very precisely, it should be understood that the degrees of separation need not be exactly as specified, and if less precision is maintained, the inches of separation will vary. The values reported on Table I should thus be considered approximate. In any event, it will be seen that the inches of separation between adjacent centers on each of the circles 15 through 20, is, in all cases, similar to the approximately ¾ of an inch separating adjacent such circles, producing an array of elements of similar size. It is also recognized that, although in the illustrated instance the effective diameter of each of the individual cuts 10 is about 1¼ inch, a somewhat deeper or shallower cut would produce a different effective diameter. For the pattern illustrated, an effective diameter in the range of between about 1 and about 1½ inches is regarded as satisfactory. Similarly, the 0.011 depth of cut reported for the illustrated embodiment should be understood as approximate and could conveniently range from between approximately 1/16th and approximately 1/128 inch depending, among other things, upon the actual radius of curvature of the end mill selected.

Reference herein to the details of the illustrated embodiments should not be regarded as limiting the scope of the appended claims which themselves recite those details regarded as important to the invention. For example, while the dimensions of the illustrated embodiment are considered to represent a particularly preferred practical device, those ordinarily skilled in the art can readily produce a device of either a smaller or larger size and/or with patterns and arrays of various complexity, without departing from the teachings of this disclosure.

What is claimed:

1. In a light of the type in which a light source is focused through a light path region of a lens element to produce a concentrated spot of light on a work area, an improved lens element comprising:

a first surface an a second surface approximately parallel said first surface; and a plurality of plano-concave negative lenses arranged in an array throughout said light path region, said array being formed from spherical depressions in open communication with said first surface, individual said depressions overlapping adjacent said depressions, thereby to provide a more uniform intensity gradation from the center of said spot to the edge of said spot than is obtainable through a conventional frosted lens.

2. An improvement according to claim 1 wherein the second said surface is flat and smooth.

3. An improvement according to claim 2 wherein said second surface is oriented towards said work area 4. An improvement according to claim 1 wherein said lens element is formed from clear material capable of passing visible light.

5. An improvement according to claim 4 wherein said light path region comprises a disc of glass or clear plastic material.

6. An improvement according to claim 5 wherein both said surfaces are smooth and polished.

7. An improvement according to claim 6 wherein said disc is formed from polycarbonate or acrylic lens material.

8. An improvement according to claim 7 wherein the second said surface is flat and smooth.

9. An improvement according to claim 8 wherein said second surface is oriented towards said work area.

10. An improvement according to claim 1 wherein said array is substantially similar to a reference array formed by machining said depressions with an end mill having a radius of curvature larger than the width of said light path region to a depth less than the distance between said first and second surfaces, the arrangement of said depressions being such that each such depression overlaps no fewer than three adjacent said depressions.

11. An improvement according to claim 10 wherein said array is arranged in a pattern generated by overlapping cuts made on centers located on concentric circles, said circles having radii originating at approximately the center of said light path region.

12. An improvement according to claim 11 wherein said concentric circles are approximately equally spaced and said centers of said overlying cuts located on each said concentric circle are also approximately evenly spaced.

13. An improvement according to claim 12 wherein a distance between said centers of adjacent said cuts on a said circle is less than a radial distance separating adjacent said circles.

14. An improvement according to claim 12 wherein said depressions in said reference array are machined to a depth of cut sufficient to achieve a diameter greater than the radial distance between adjacent said circles.

15. An improvement according to claim 14 wherein said depth of cut is less than about ½ the distance separating said first and second surfaces.

16. An improvement according to claim 11 wherein said lens element is formed from clear material capable of passing visible light.

17. An improvement according to claim 16 wherein said light path region comprises a disc of glass or clear plastic material.

18. An improvement according to claim 17 wherein both said surfaces are smooth and polished.

19. An improvement according to claim 18 wherein said disc is formed from polycarbonate or acrylic lens material.

20. An improvement according to claim 19 wherein the second said surface is flat and smooth.

21. An improvement according to claim 20 wherein said second surface is oriented towards said work area.

22. An improvement according to claim 19 wherein said concentric circles are approximately equally spaced and said centers of said overlapping cuts located on each said concentric circle are also approximately evenly spaced.

23. An improvement according to claim 22 wherein the distance between said centers of adjacent said cuts on a said circle is less than the radial distance separating adjacent said circles.

24. An improvement according to claim 23 wherein the second said surface is flat and smooth.

25. An improvement according to claim 24 wherein said second surface is oriented towards said work area.

26. An improvement according to claim 11 wherein said centers of said cuts are located approximately 60° apart on a said circle with a radius of approximately one inch; approximately 24° apart on a said circle with a radius of approximately 1¾ inches; approximately 18° apart on a said circle with a radius of approximately 2½ inches; approximately 15° apart on a said circle with a radius of approximately 3¼ inches; approximately 12° apart on a said circle with a radius of approximately 4 inches; and approximately 10° apart on a said circle with a radius of approximately 4¾ inches.

27. An improvement according to claim 26 wherein the effective diameter of each said cut at said first surface is between about 1 and about 1½ inches.

28. An improvement according to claim 27 wherein the depth of cut of said depressions is between about 1/16 and about 1/128 inch.

29. An improvement according to claim 28 wherein said second surface is flat and smooth and said light path region is constructed of clear polycarbonate or acrylic plastic.

30. An improvement according to claim 28 wherein the centers of said cuts are positioned on said circles to avoid adjacent said centers from defining a radius from said center of said light pattern region.

* * * * *